US011298738B2

(12) United States Patent
Nogiwa et al.

(10) Patent No.: US 11,298,738 B2
(45) Date of Patent: Apr. 12, 2022

(54) FORMING DEVICE AND FORMING METHOD

(71) Applicant: SUMITOMO HEAVY INDUSTRIES, LTD., Tokyo (JP)

(72) Inventors: Kimihiro Nogiwa, Ehime (JP); Masayuki Ishizuka, Ehime (JP); Masayuki Saika, Ehime (JP); Norieda Ueno, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 308 days.

(21) Appl. No.: 16/522,405

(22) Filed: Jul. 25, 2019

(65) Prior Publication Data

US 2019/0344321 A1 Nov. 14, 2019

Related U.S. Application Data

(63) Continuation of application No. PCT/JP2018/003956, filed on Feb. 6, 2018.

(30) Foreign Application Priority Data

Mar. 17, 2017 (JP) ..... JP2017-052608

(51) Int. Cl.
*B21D 26/033* (2011.01)

(52) U.S. Cl.
CPC ..... *B21D 26/033* (2013.01)

(58) Field of Classification Search
CPC .. B21D 26/033; B21D 26/039; B21D 26/041; B21D 26/043; B21D 26/045;
(Continued)

(56) References Cited

U.S. PATENT DOCUMENTS 5,918,494 A * 7/1999 Kojima ..... B21D 26/047 72/58
2010/0186473 A1* 7/2010 Mizumura ..... B21D 26/033 72/60
2010/0186477 A1 7/2010 Barthelemy et al.

FOREIGN PATENT DOCUMENTS

DE 195 35 870 A1 2/1997
DE 10 2006 041110 A1 10/2007
(Continued)

OTHER PUBLICATIONS

Search Report issued in European Application No. 18766585.6, dated Feb. 13, 2020.
(Continued)

*Primary Examiner* — Adam J Eiseman
*Assistant Examiner* — Fred C Hammers
(74) *Attorney, Agent, or Firm* — Michael Best & Friedrich LLP

(57) ABSTRACT

A forming device of forming a metal pipe having a pipe portion includes a first die and a second die constituting a first cavity portion configured to form the pipe portion and a second cavity portion configured to form a flange portion, a drive mechanism configured to move at least one of the first die and the second die, and a gas supply unit configured to supply a gas into a metal pipe material which is held between the first die and the second die and is heated, in which each of the first die and the second die has flange forming surfaces which face each other and constitute the second cavity portion, and a protrusion portion, which protrudes from one flange forming surface to the other flange forming surface, is formed on at least one of the flange forming surfaces of the first die and the second die.

4 Claims, 14 Drawing Sheets

(58) Field of Classification Search
CPC ..... B21D 26/047; B21D 37/04; B21D 37/08; B21D 37/10; B21D 37/16
See application file for complete search history.

(56) References Cited

FOREIGN PATENT DOCUMENTS

| | | | | | |
|---|---|---|---|---|---|
| JP | 2004-082136 | A | | 3/2004 | |
| JP | 2006-061944 | A | | 3/2006 | |
| JP | 2006061944 | | * | 3/2006 | ..... B21D 26/02 |
| JP | 2006061944 | A | * | 3/2006 | |
| JP | 2006-122979 | A | | 5/2006 | |
| JP | 2012000654 | | * | 6/2010 | ..... B21D 26/035 |
| JP | 2012000654 | A | * | 6/2010 | |
| JP | 2012-000654 | A | | 1/2012 | |
| JP | 2013-158785 | A | | 8/2013 | |
| JP | 2016-129891 | A | | 7/2016 | |

OTHER PUBLICATIONS

International Search Report issued in Application No. PCT/JP2018/003956, dated Apr. 10, 2018.

* cited by examiner

FORMING DEVICE AND FORMING METHOD

RELATED APPLICATIONS

The contents of Japanese Patent Application No. 2017-052608, and of International Patent Application No. PCT/JP2018/003956, on the basis of each of which priority benefits are claimed in an accompanying application data sheet, are in their entirety incorporated herein by reference.

BACKGROUND

Technical Field

Certain embodiment of the present invention relates to a forming device and a forming method.

Description of Related Art

In the related art, a forming device is known in which a gas is supplied into a heated metal pipe material so as to expand the metal pipe material and a metal pipe having a pipe portion and a flange portion is formed. For example, a forming device described in the related art includes an upper die and a lower die which are paired with each other, a gas supply unit which supplies a gas into a metal pipe material held between the upper die and the lower die, a first cavity portion (main cavity) which is formed by joining between the upper die and the lower die and forms a pipe portion, and a second cavity portion (sub cavity) which communicates with the first cavity portion and forms a flange portion. In the forming device, the dies are closed and the gas is supplied into the heated metal pipe material so as to expand the metal pipe material, and thus, the pipe portion and the flange portion can be simultaneously formed.

SUMMARY

According to an embodiment of the present invention, there is provided a forming device of forming a metal pipe having a pipe portion, including: a first die and a second die which are paired with each other, and constitute a first cavity portion configured to form the pipe portion and a second cavity portion which communicates with the first cavity portion and is configured to form a flange portion of the metal pipe when the first and second dies are closed; a drive mechanism configured to move at least one of the first die and the second die in a direction in which the dies are joined to each other; and a gas supply unit configured to supply a gas into a metal pipe material which is held between the first die and the second die and is heated, in which each of the first die and the second die has flange forming surfaces which face each other and constitute the second cavity portion, and a protrusion portion, which protrudes from one flange forming surface to the other flange forming surface, is formed on at least one of the flange forming surfaces of the first die and the second die.

According to another embodiment of the present invention, there is provided a forming device of forming a metal pipe having a pipe portion, including: a first die and a second die which are paired with each other, and constitute a first cavity portion configured to form the pipe portion and a second cavity portion which communicates with the first cavity portion and is configured to form a flange portion of the metal pipe when the first and second dies are closed; a heating unit configured to heat the metal pipe; a drive mechanism configured to move at least one of the first die and the second die in a direction in which the dies are joined to each other; and a gas supply unit configured to supply a gas into a metal pipe material which is held between the first die and the second die and is heated, in each of the first die and the second die has flange forming surfaces which face each other and constitute the second cavity portion, a protrusion mechanism configured to be switchable between a protrusion and a non-protrusion from at least one of the flange forming surfaces of the first die and the second die is formed on the one flange forming surface, and the protrusion mechanism protrudes from the one flange forming surface to the other flange forming surface when the protrusion mechanism protrudes.

According to still another embodiment of the present invention, there is provided a forming method of forming a metal pipe having a pipe portion, including: preparing a heated metal pipe material between a first die and a second die; forming a first cavity portion configured to form the pipe portion and a second cavity portion which communicates with the first cavity portion and is configured to form a flange portion of the metal pipe between the first die and the second die by moving at least one of the first die and the second die in a direction in which the dies are joined to each other; forming the pipe portion and the flange portion extending from the pipe portion by supplying a gas into the metal pipe material; and forming a gap portion in which inner surfaces facing each other are separated from each other to form a gap and a proximity portion in which the inner surfaces are close to each other compared to the gap portion, inside the flange portion.

BRIEF DESCRIPTION OF THE DRAWINGS

FIG. 3A is a view showing a state where the electrode holds a metal pipe material, FIG. 3B is a view showing a state where a seal member abuts against the electrode, and FIG. 3C is a front view of the electrode.

FIG. 4A is a view showing a state where the metal pipe material is set in the die, and FIG. 4B is a view showing a state where the metal pipe material is held by the electrode.

DETAILED DESCRIPTION

Figure 1:
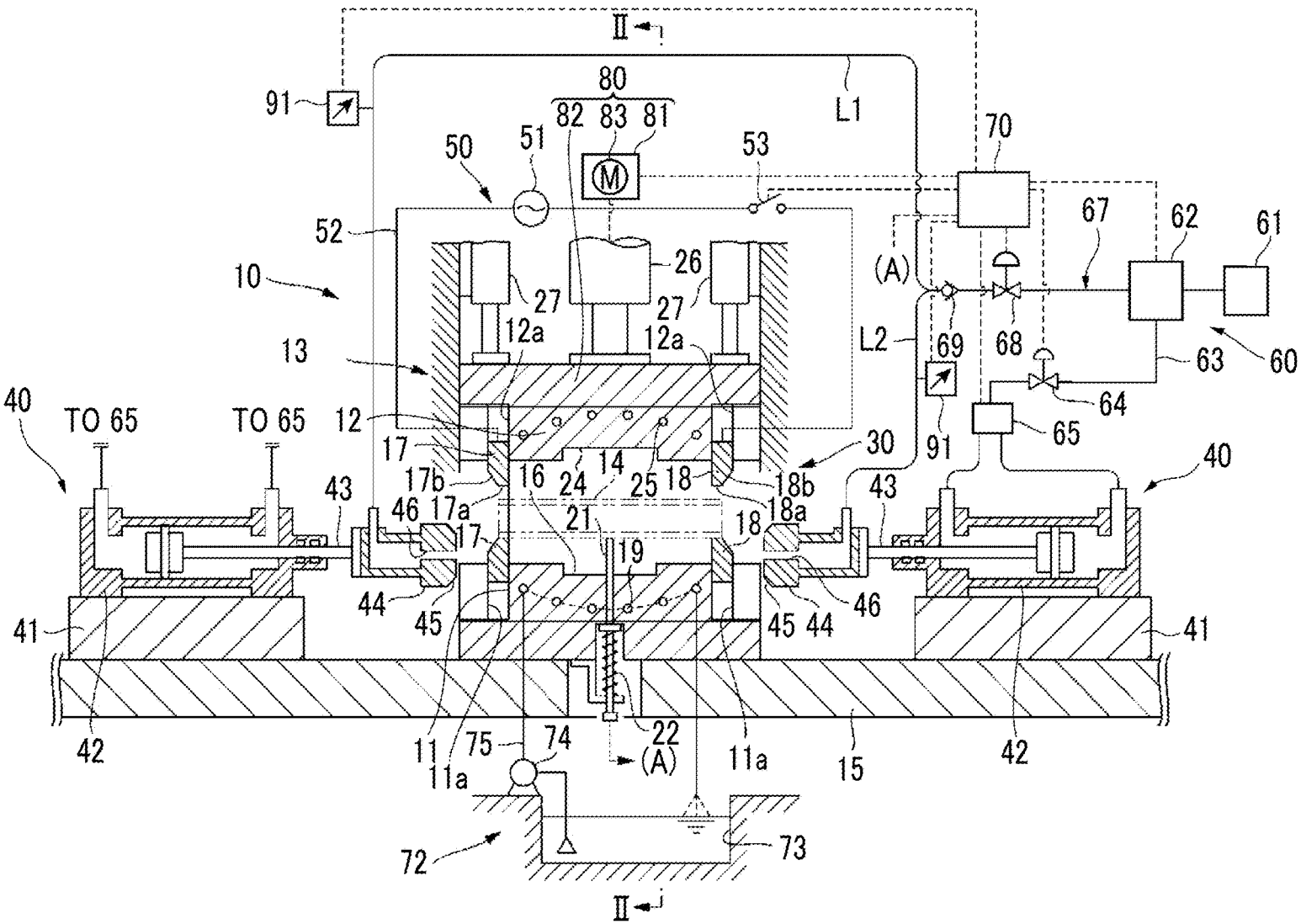
FIG. 1 is a schematic configuration view of a forming device.

A coating liquid may be applied to a formed metal pipe material for the purpose of rust prevention or the like. In a forming device of the related art, when a flange portion is completely crushed, the coating liquid does not enter an inside of the flange portion. Meanwhile, if a space inside the flange portion is enlarged to cause the coating liquid easily to enter the inside of the flange portion, a large gap is generated in the flange portion, and thus, weldability decreases when the flange portion and other members are welded to each other.

It is desirable to provide a forming device and a forming method capable of facilitating entry of the coating liquid into the flange portion while securing the weldability of the flange portion of the metal pipe.

According to a forming device of the present invention, a first die and a second die constitute a second cavity portion communicating with a first cavity portion, and thus, a flange portion of a metal pipe can be formed by crushing a portion of a pipe portion with the second cavity portion. Here, each of the first die and the second die has flange forming surfaces which face each other and constitute the second cavity portion. In addition, a protrusion portion, which protrudes from one flange forming surface to the other flange forming surface, is formed on at least one of the flange forming surfaces of the second cavity portion of the first die and the second die. Accordingly, in the flange portion, a location corresponding to the protrusion portion can be more firmly crushed compared to the other portions. Therefore, weldability of the flange portion can be secured by performing welding at a portion corresponding to the protrusion portion in the flange portion. Meanwhile, a gap in which a coating liquid can enter can be secured in portions other than the protrusion portion in the flange portion. As described above, the coating liquid can easily enter the inside of the flange portion while the weldability of the flange portion of the metal pipe is secured.

In addition, the protrusion portion may be intermittently formed on the flange forming surface along an extension direction of the first cavity portion. In this case, a gap is formed in the extension direction of the second cavity portion at the location pressed by the protrusion portion. The coating liquid enters the gap, and thus, the coating liquid can easily enter throughout the entire flange portion.

Moreover, the protrusion portion may be formed inside an outer end portion of the flange forming surface. In this case, a welding location can also be set inside the outer end portion in the flange portion. Accordingly, it is possible to easily perform a welding operation.

According to the forming device of the present invention, the first die and the second die constitute the second cavity portion communicating with the first cavity portion, and thus, the flange portion of the metal pipe can be formed by crushing a portion of the pipe portion with the second cavity portion. Here, each of the first die and the second die has the flange forming surfaces which face each other and constitute the second cavity portion. In addition, the protrusion mechanism configured to be switchable between a protrusion and a non-protrusion from at least one of the flange forming surfaces of the second cavity portion of the first die and the second die is formed on the one flange forming surface. The protrusion mechanism protrudes from the one flange forming surface to the other flange forming surface when the protrusion mechanism protrudes. Accordingly, in the flange portion, a location corresponding to the protrusion mechanism can be more firmly crushed compared to the other portions. Therefore, weldability of the flange portion can be secured by performing welding at a portion corresponding to the protrusion mechanism in the flange portion. Meanwhile, a gap in which a coating liquid can enter can be secured in portions other than the protrusion portion in the flange portion. As described above, the coating liquid can easily enter the inside of the flange portion while the weldability of the flange portion of the metal pipe is secured.

In addition, the protrusion mechanism may be intermittently formed on the flange forming surface along an extension direction of the first cavity portion. In this case, a gap is formed in the extension direction of the second cavity portion at a location pressed by the protrusion mechanism. The coating liquid enters the gap, and thus, the coating liquid can easily enter throughout the entire flange portion.

Moreover, the protrusion mechanism may be formed inside an outer end portion of the flange forming surface. In this case, a welding location can also be set inside the outer end portion in the flange portion. Accordingly, it is possible to easily perform a welding operation.

According to a forming method of the present invention, it is possible to obtain operations and effects similar to those of the above-described forming device.

According to the present invention, a coating liquid can easily enter the inside of a flange portion while weldability of a flange portion of a metal pipe is secured.

Hereinafter, preferred embodiments of a forming device and a forming method according to the present invention will be described with reference to the drawings. In addition, in each drawing, the same reference numerals are assigned to the same portions or the corresponding portions, and repeated descriptions thereof are omitted.

<Configuration of Forming Device>

FIG. 1 is a schematic configuration view of a forming device.

As shown in FIG. 1, a forming device 10 for forming a metal pipe 100 (refer to FIG. 5) includes a blow forming die 13 including an upper die (first die) 12 and a lower die (second die) 11 which are paired with each other, a drive mechanism 80 which moves at least one of the upper die 12 and the lower die 11, a pipe holding mechanism (holding unit) 30 which holds a metal pipe material 14 between the upper die 12 and a lower die 11, a heating mechanism (heating unit) 50 which supplies power to the metal pipe material 14 held by the pipe holding mechanism 30 and heats the metal pipe material 14, a gas supply unit 60 which supplies a high-pressure gas (gas) into the metal pipe material 14 which is held between the upper die 12 and the lower die 11 and is heated, a pair of gas supply mechanisms 40 and 40 for supplying the gas from the gas supply unit 60 into the metal pipe material 14 held by the pipe holding mechanism 30, and a water circulation mechanism 72 which forcibly water-cools the blow forming die 13. In addition, the forming device 10 is configured to include a controller 70 which controls driving of the drive mechanism 80, driving of the pipe holding mechanism 30, driving of the heating mechanism 50, and gas supply of the gas supply unit 60.

The lower die (second die) 11 is fixed to a large base 15. The lower die 11 is configured of a large steel block and includes a cavity surface 16 on an upper surface of the lower die 11. In addition, electrode receiving spaces 11*a* are provided around right and left ends (right and left ends in FIG. 1) of the lower die 11. The forming device 10 includes a first electrode 17 and a second electrode 18 which are configured so as to be movable upward or downward by an actuator (not shown) in the electrode receiving spaces 11*a*. Semicircular arc-shaped concave grooves 17*a* and 18*a* corresponding to a lower outer peripheral surface of the metal pipe material 14 are formed on upper surfaces of the first electrode 17 and the second electrode 18 (refer to FIG. 3C), and the metal pipe material 14 can be placed so as to be exactly fitted into the portions of the concave grooves 17*a* and 18*a*. In addition, a tapered concave surface 17*b* having a periphery inclined in a taper shape toward the concave groove 17*a* is formed on a front surface (a surface in an outside direction of the die) of the first electrode 17, and a tapered concave surface 18*b* having a periphery inclined in a taper shape toward the concave groove 18*a* is formed on a front surface (the surface in the outside direction of the die) of the second electrode 18. A cooling water passage 19 is formed in the lower die 11, and the lower die 11 includes a thermocouple 21 which is inserted from below at an approximately center. The thermocouple 21 is supported to be movable upward or downward by a spring 22.

In addition, the first and second electrodes 17 and 18 located on the lower die 11 side constitute the pipe holding mechanism 30, and can support the metal pipe material 14 between the upper die 12 and the lower die 11 such that the metal pipe material 14 can be lifted and lowered. Moreover, the thermocouple 21 merely shows an example of temperature measuring means, and a non-contact type temperature sensor such as a radiant thermometer or a photo-thermometer may be used. If a correlation between an energization time and a temperature is obtained, it is sufficiently possible to eliminate the temperature measuring means.

The upper die (first die) 12 includes a cavity surface 24 on a lower surface and is a large steel block which houses a cooling water passage 25. An upper end portion of the upper die 12 is fixed to a slide 82. In addition, the slide 82 to which the upper die 12 is fixed is configured to be suspended by a pressurizing cylinder 26, and is guided by a guide cylinder 27 so as not to sway.

Similarly to the lower die 11, electrode receiving spaces 12*a* are provided around right and left ends (right and left ends in FIG. 1) of the upper die 12. Similarly to the lower die 11, the forming device 10 includes a first electrode 17 and a second electrode 18 which are configured so as to be movable upward or downward by an actuator (not shown) in the electrode receiving spaces 12*a*. Semicircular arc-shaped concave grooves 17*a* and 18*a* corresponding to an upper outer peripheral surface of the metal pipe material 14 are formed on lower surfaces of the first electrode 17 and the second electrode 18 (refer to FIG. 3C), and the metal pipe material 14 can be exactly fitted into the concave grooves 17*a* and 18*a*. In addition, a tapered concave surface 17*b* having a periphery inclined in a taper shape toward the concave groove 17*a* is formed on a front surface (a surface in the outside direction of the die) of the first electrode 17, and a tapered concave surface 18*b* having a periphery inclined in a taper shape toward the concave groove 18*a* is formed on a front surface (the surface in the outside direction of the die) of the second electrode 18. Accordingly, the pair of first and second electrodes 17 and 18 located on the upper die 12 side also constitutes the pipe holding mechanism 30, and if the metal pipe material 14 is clamped from above and below by a pair of upper and lower first and second electrodes 17 and 18, the upper and lower first and second electrodes 17 and 18 can exactly surround the outer periphery of the metal pipe material 14 so as to come into close contact with the entire circumference of the metal pipe material 14.

The drive mechanism 80 includes the slide 82 which moves the upper die 12 such that the upper die 12 and the lower die 11 are joined to each other, a drive unit 81 which generates a driving force for moving the slide 82, and a servo motor 83 which controls a fluid volume with respect to the drive unit 81. The drive unit 81 is configured of a fluid supply unit which supplies a fluid (a working oil in a case where a hydraulic cylinder is adopted as the pressurizing cylinder 26) which drives the pressurizing cylinder 26 to the pressurizing cylinder 26.

The controller 70 controls the servo motor 83 of the drive unit 81 so as to control an amount of the fluid supplied to the pressurizing cylinder 26, and thus, can control the movement of the slide 82. In addition, it should be noted that the drive unit 81 is not limited to the drive unit that applies the driving force to the slide 82 via the pressurizing cylinder 26 as described above. For example, the drive unit 81 may be a drive unit which mechanically connects a drive mechanism to the slide 82 and directly or indirectly applies a driving force generated by the servo motor 83 to the slide 82. For example, a drive mechanism may be adopted, which includes an eccentric shaft, a drive source (for example, a servo motor, a speed reducer, or the like) which applies a rotation force by which the eccentric shaft is rotated, a conversion unit (for example, a connecting rod, an eccentric sleeve, or the like) which converts a rotation motion of the eccentric shaft into a linear motion and moves the slide. In addition, in the present embodiment, the drive unit 81 may not include the servo motor 83.

Figure 2A:
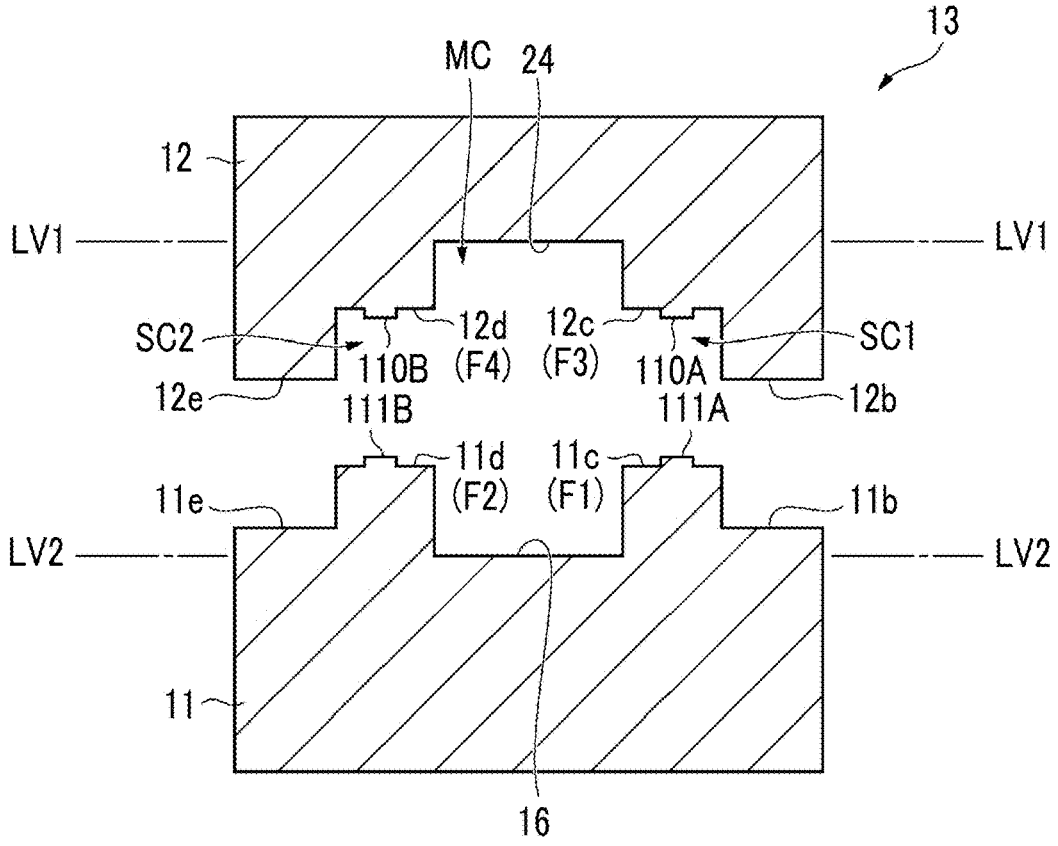
FIGS. 2A and 2B are sectional views of a blow forming die taken along line II-II shown in FIG. 1.
Figure 2B:
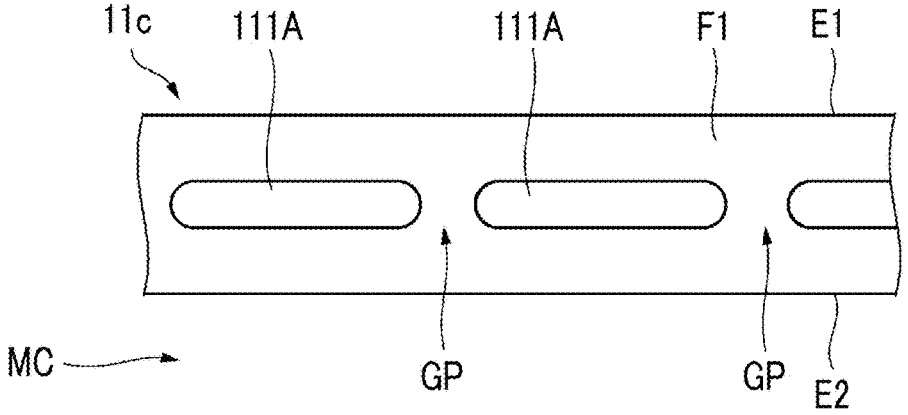

FIGS. 2A and 2B are sectional views of the blow forming die 13 taken along line II-II shown in FIG. 1. As shown in FIGS. 2A and 2B, steps are provided on both the upper surface of the lower die 11 and the lower surface of the upper die 12.

If the center cavity surface 16 of the lower die 11 is defined as a reference line LV2, the step is formed on the upper surface of the lower die 11 by a first protrusion 11*b*, a second protrusion 11*c*, a third protrusion 11*d*, and a fourth protrusion 11*e*. The first protrusion 11*b* and the second protrusion 11*c* are formed on a right side (a right side in FIG. 2A and a rear side of a paper surface in FIG. 1) of the cavity surface 16, and the third protrusion 11*d* and the fourth protrusion 11*e* are formed on a left side (a left side in FIG. 2A and a front side of the paper surface in FIG. 1) of the cavity surface 16. The second protrusion 11*c* is located between the cavity surface 16 and the first protrusion 11*b*. The third protrusion 11*d* is located between the cavity surface 16 and the fourth protrusion 11*e*. The second protrusion 11*c* and the third protrusion 11*d* respectively protrude toward the upper die 12 side from the first protrusion 11*b* and the fourth protrusion 11*e*. Protrusion amounts of the first protrusion 11*b* and the fourth protrusion 11*e* from the reference line LV2 are approximately the same as each other, and protrusion amounts of the second protrusion 11*c* and the third protrusion 11*d* from the reference line LV2 are approximately the same as each other.

Meanwhile, if a surface of the center cavity surface 24 of the upper die 12 is defined as a reference line LV1, the step is formed on the lower surface of the upper die 12 by a first protrusion 12*b*, a second protrusion 12*c*, a third protrusion 12*d*, and a fourth protrusion 12*e*. The first protrusion 12*b* and the second protrusion 12*c* are formed on a right side (a right side in FIG. 2) of the cavity surface 24, and the third protrusion 12*d* and the fourth protrusion 12*e* are formed on a left side (a left side in FIG. 2) of the cavity surface 24. The second protrusion 12*c* is located between the cavity surface 24 and the first protrusion 12*b*. The third protrusion 12*d* is located between the cavity surface 24 and the fourth protrusion 12*e*. The first protrusion 12*b* and the fourth protrusion 12*e* respectively protrude toward the lower die 11 side from the second protrusion 12*c* and the third protrusion 12*d*. Protrusion amounts of the first protrusion 12*b* and the fourth protrusion 12*e* from the reference line LV1 are approximately the same as each other, and protrusion amounts of the second protrusion 12*c* and the third protrusion 12*d* from the reference line LV1 are approximately the same as each other.

In addition, the first protrusion 12*b* of the upper die 12 faces the first protrusion 11*b* of the lower die 11, the second protrusion 12*c* of the upper die 12 faces the second protrusion 11*c* of the lower die 11, the cavity surface 24 of the upper die 12 faces the cavity surface 16 of the lower die 11, the third protrusion 12*d* of the upper die 12 faces the third protrusion 11*d* of the lower die 11, and the fourth protrusion 12*e* of the upper die 12 faces the fourth protrusion 11*e* of the lower die 11. In addition, a protrusion amount (a protrusion amount of the fourth protrusion 12*e* with respect to the third protrusion 12*d*) of the first protrusion 12*b* with respect to the second protrusion 12*c* in the upper die 12 is larger than a protrusion amount (a protrusion amount of the third protrusion 11*d* with respect to the fourth protrusion 11*e*) of the second protrusion 11*c* with respect to the first protrusion 11*b* in the lower die 11. According, when the upper die 12 and the lower die 11 are fitted to each other, spaces are respectively formed between the second protrusion 12*c* of the upper die 12 and the second protrusion 11*c* of the lower die 11 and between the third protrusion 12*d* of the upper die 12 and the third protrusion 11*d* of the lower die 11 (refer to FIG. 6C). In addition, when the upper die 12 and the lower die 11 are fitted to each other, a space is formed between the cavity surface 24 of the upper die 12 and the cavity surface 16 of the lower die 11 (refer to FIG. 6C).

Figure 6A:
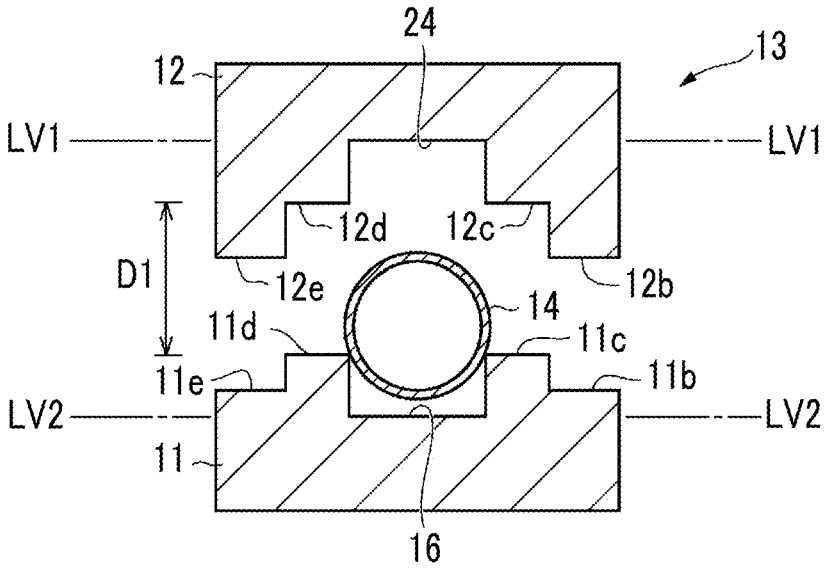
FIGS. 6A to 6D are views showing an operation of the blow forming die and a change of a shape of the metal pipe material.
Figure 6B:
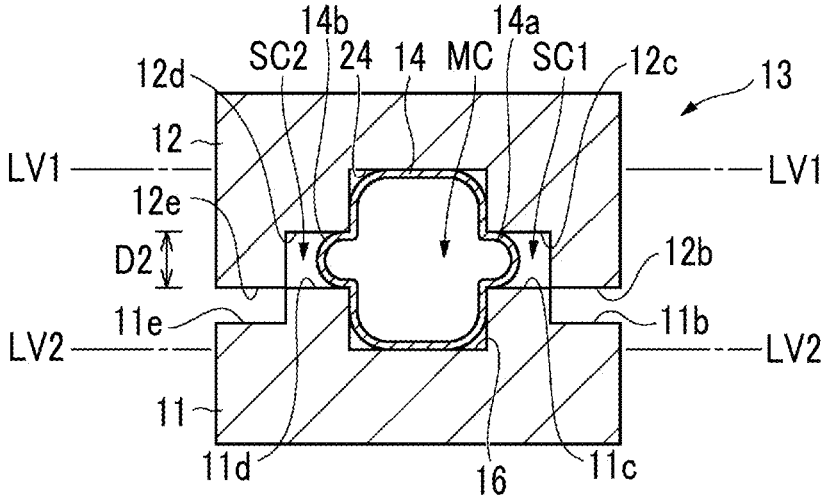
Figure 6C:
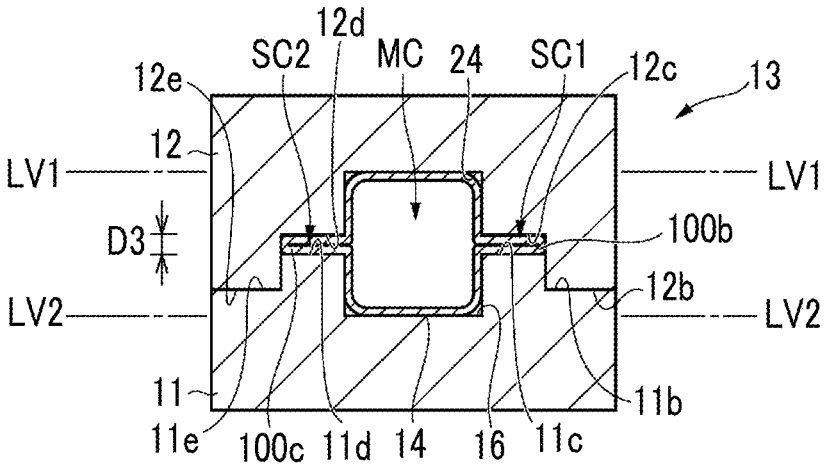
Figure 6D:
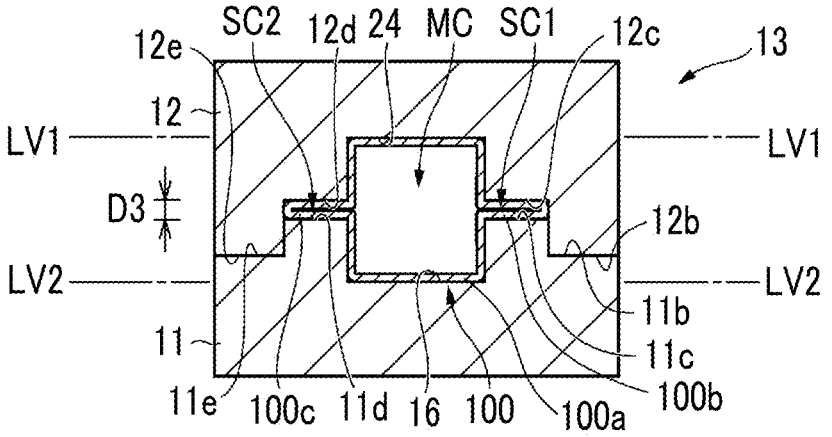

More specifically, when blow forming is performed, at a time before the lower die 11 and the upper die 12 are joined and fitted to each other, as shown in FIG. 6B, a main cavity portion (first cavity portion) MC is formed between a surface (a surface becoming the reference line LV1) of the cavity surface 24 of the upper die 12 and a surface (a surface becoming the reference line LV2) of the cavity surface 16 of the lower die 11. In addition, a sub cavity portion (second cavity portion) SC1 which communicates with the main cavity portion MC and has a volume smaller than that of the main cavity portion MC is formed between the second protrusion 12*c* of the upper die 12 and the second protrusion 11*c* of the lower die 11. Similarly, a sub cavity portion (second cavity portion) SC2 which communicates with the main cavity portion MC and has a volume smaller than that of the main cavity portion MC is formed between the third protrusion 12*d* of the upper die 12 and the third protrusion 11*d* of the lower die 11. The main cavity portion MC is a portion which forms a pipe portion 100*a* in the metal pipe 100 and sub cavity portions SC1 and SC2 are portions which respectively form flange portions 100*b* and 100*c* in the metal pipe 100 (refer to FIGS. 6C and 6D). In addition, as shown in FIGS. 6C and 6D, in a case where the lower die 11 and the upper die 12 are joined (fitted) to each other so as to be completely closed, the main cavity portion MC and the sub cavity portions SC1 and SC2 are sealed in the lower die 11 and the upper die 12. In addition, protrusion portions 110A and 110B are formed on the upper die 12, and protrusion portions 111A and 111B are formed on the lower die 11. Details of the protrusion portions will be described later.

As shown in FIG. 1, the heating mechanism 50 includes a power supply 51, conducting wires 52 which extend from the power supply 51 and are connected to the first electrode 17 and the second electrode 18, and a switch 53 which is interposed between the conducting wires 52. The controller 70 controls the heating mechanism 50, and thus, the metal pipe material 14 can be heated to a quenching temperature (above an AC3 transformation point temperature).

Figure 3A:
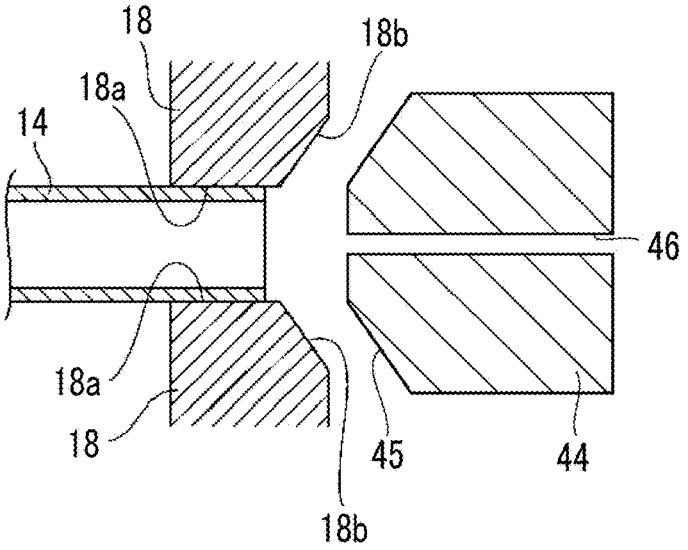
FIGS. 3A to 3C are enlarged views of a periphery of an electrode.
Figure 3B:
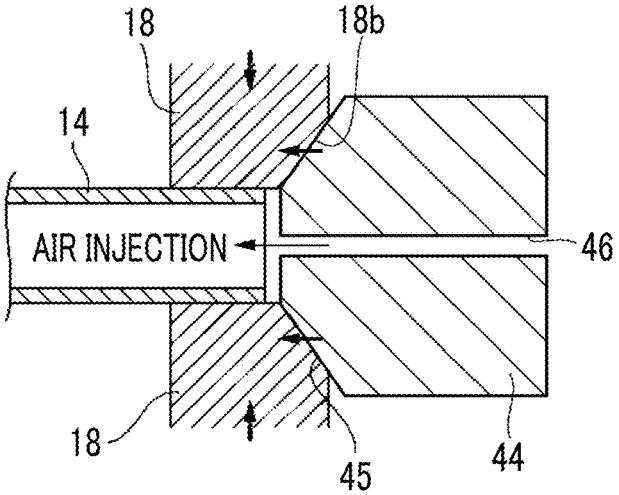
Figure 3C:
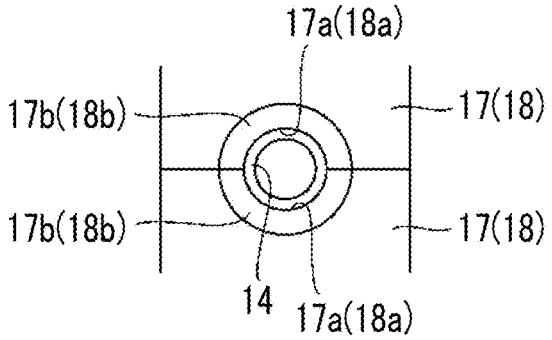

Each of the pair of gas supply mechanisms 40 includes a cylinder unit 42, a cylinder rod 43 which moves forward and rearward in accordance with an operation of the cylinder unit 42, and a seal member 44 connected to a tip of the cylinder rod 43 on the pipe holding mechanism 30 side. The cylinder unit 42 is placed on and fixed to the base 15 via a block 41. At a tip of each seal member 44, a tapered surface 45 is formed to be tapered. One tapered surface 45 is configured to have a shape which can be exactly fitted to the tapered concave surface 17*b* of the first electrode 17 so as to abut against the tapered concave surface 17*b*, and the other tapered surface 45 is configured to have a shape which can be exactly fitted to the tapered concave surface 18*b* of the second electrode 18 so as to abut against the tapered concave surface 18*b* (refer to FIG. 3A to 3C). The seal member 44 extends from the cylinder unit 42 side toward the tip. More specifically, as shown in FIGS. 3A and 3B, a gas passage 46 through which a high-pressure gas supplied form the gas supply unit 60 flows is provided.

Returning to FIG. 1, the gas supply unit 60 includes a gas source 61, an accumulator 62 in which the gas supplied by the gas source 61 is stored, a first tube 63 which extends from the accumulator 62 to the cylinder unit 42 of the gas supply mechanism 40, a pressure control valve 64 and a switching valve 65 which are interposed in the first tube 63, a second tube 67 which extends from the accumulator 62 to the gas passage 46 formed in the seal member 44, and a pressure control valve 68 and a check valve 69 which are interposed in the second tube 67. The pressure control valve 64 plays a role of supplying gas of an operating pressure adapted to a pushing force of the seal member 44 with respect to the metal pipe material 14 to the cylinder unit 42. The check valve 69 plays a role of preventing the gas from back-flowing in the second tube 67.

In addition, information is transmitted to the controller 70 from (A) shown in FIG. 1, and thus, the controller 70 acquires temperature information from the thermocouple 21 and controls the pressurizing cylinder 26, the switch 53, or the like. The water circulation mechanism 72 includes a water tank 73 which stores water, a water pump 74 which pumps up the water stored in the water tank 73, pressurizes the water, and feeds the pressurized water to the cooling water passage 19 of the lower die 11 and the cooling water passage 25 of the upper die 12, and a pipe 75. Although omitted, a cooling tower for lowering a water temperature and a filter for purifying the water may be interposed in the pipe 75.

<Forming Method of Metal Pipe Using Forming Device>

Figure 4A:
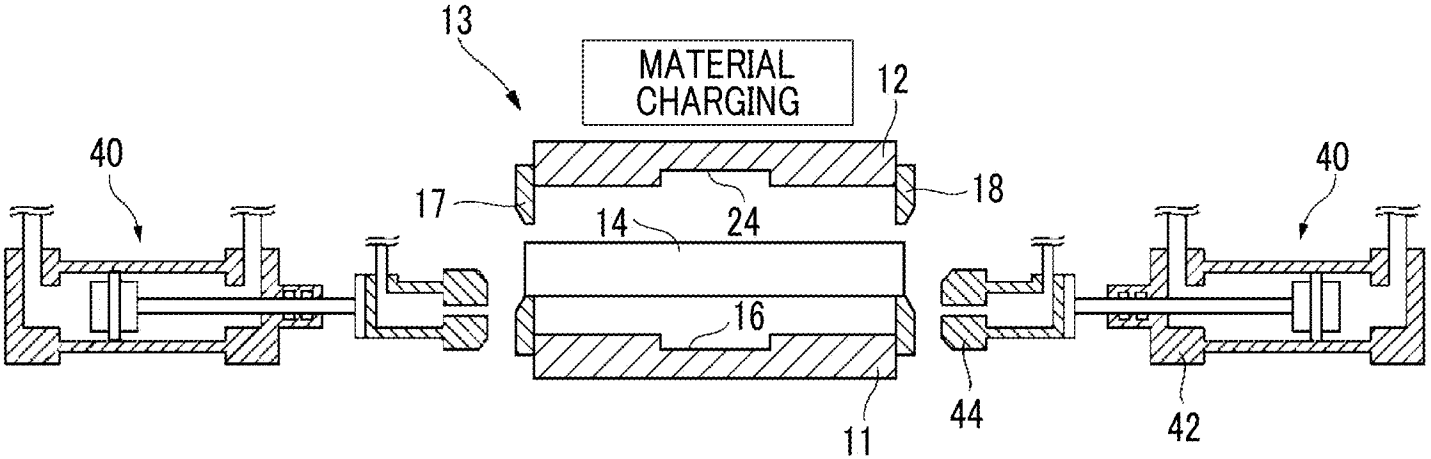
FIGS. 4A and 4B are view showing a manufacturing step performed by the forming device.
Figure 4B:
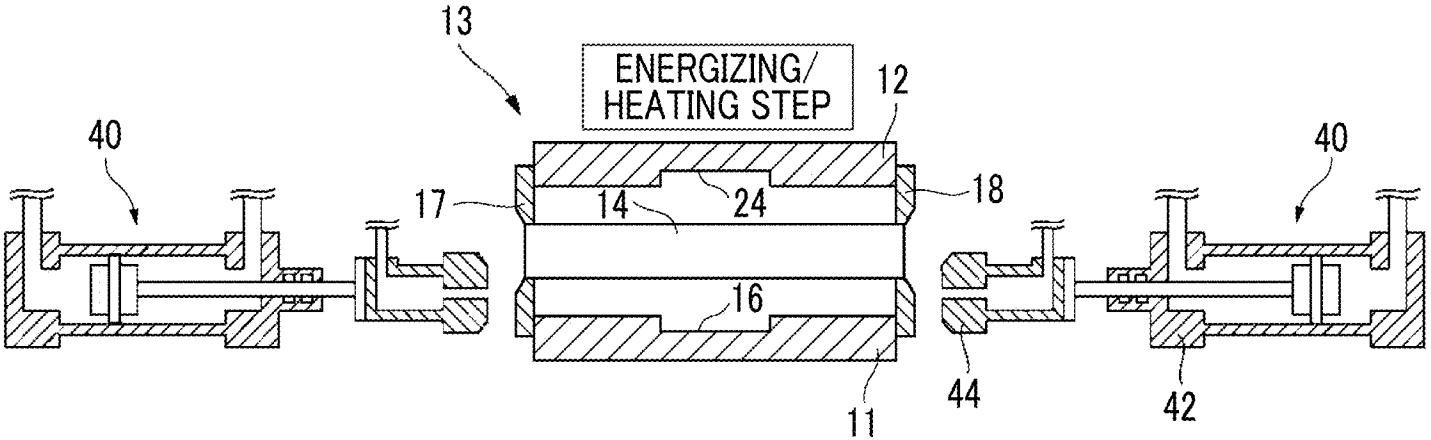

Next, a forming method of the metal pipe using the forming device 10 will be described. FIGS. 4A and 4B show steps from a pipe charging step of charging the metal pipe material 14 as a material to an energizing/heating step of energizing and heating the metal pipe material 14. Initially, the metal pipe material 14 of a hardenable steel type is prepared. As shown in FIG. 4A, for example, the metal pipe material 14 is placed on (charged in) the first and second electrodes 17 and 18, which are provided on the lower die 11 side, using a robot arm or the like. The concave grooves 17*a* and 18*a* are respectively formed on the first and second electrodes 17 and 18, and thus, the metal pipe material 14 is located by the concave grooves 17*a* and 18*a*. Next, the controller 70 (refer to FIG. 1) controls the pipe holding mechanism 30, and thus, the metal pipe material 14 is held by the pipe holding mechanism 30. Specifically, as shown in FIG. 4B, an actuator (not shown) which can move the first electrode 17 and the second electrode 18 forward or rearward is operated, and thus, the first and second electrodes 17 and 18 located above and below approach each other and abut against each other. According to this abutment, both end portions of the metal pipe material 14 are clamped from above and below by the first and second electrodes 17 and 18. In addition, this clamping is performed in an aspect in which the concave grooves 17*a* and 18*a* respectively formed on the first and second electrodes 17 and 18 are provided such that the first and second electrodes 17 and 18 come into close contact with the entire circumference of the metal pipe material 14. However, the present invention is not limited to the configuration in which the first and second electrodes 17 and 18 come into close contact with the entire circumference of the metal pipe material 14. That is, the first and second electrodes 17 and 18 may abut against a portion of the metal pipe material 14 in the circumferential direction.

Subsequently, as shown in FIG. 1, the controller 70 controls the heating mechanism 50 so as to heat the metal pipe material 14. Specifically, the controller 70 turns on the switch 53 of the heating mechanism 50. Accordingly, power from the power supply 51 is supplied to the metal pipe material 14, and the metal pipe material 14 itself is heated (Joule heat) by a resistance existing in the metal pipe material 14. In this case, a measurement value of the thermocouple 21 is always monitored, and the energization is controlled based on this result.

Figure 5:
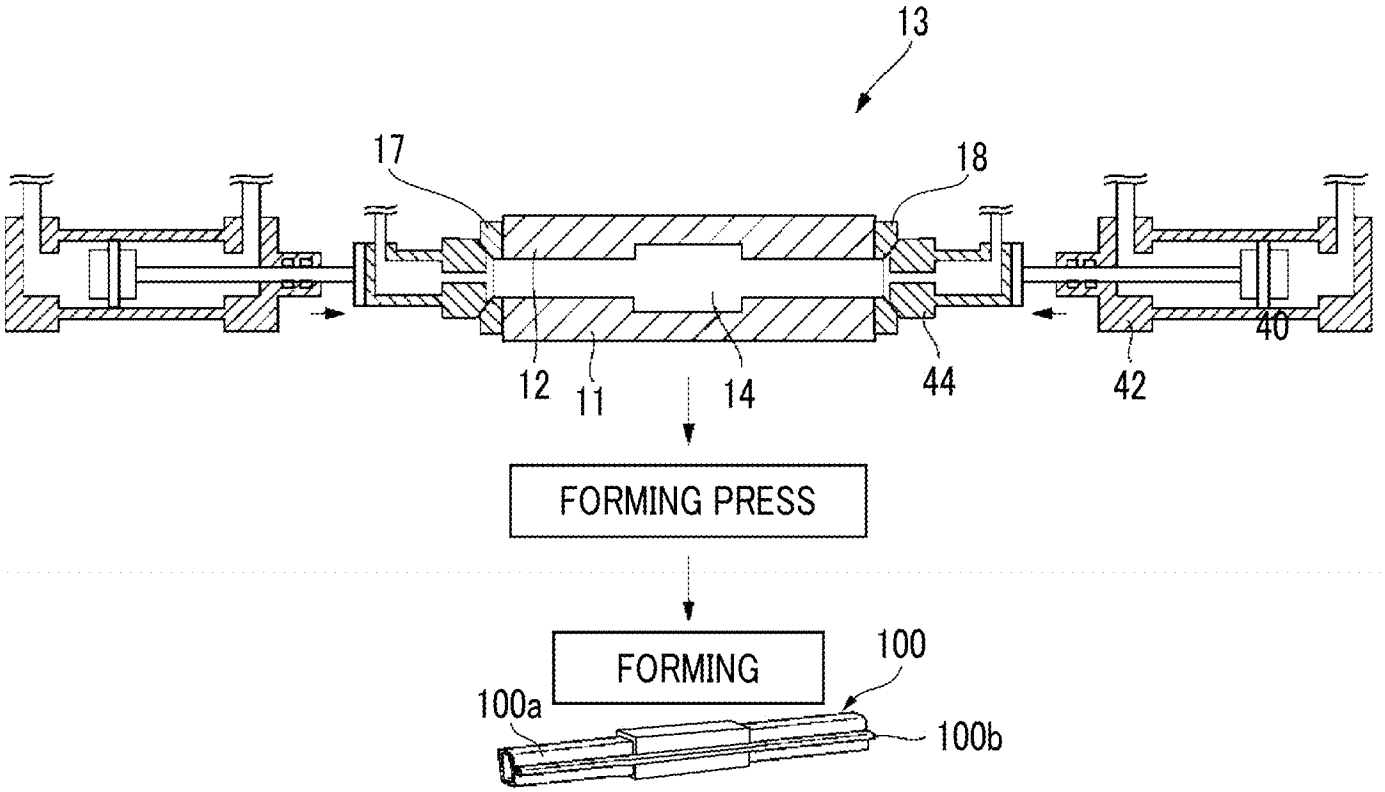
FIG. 5 is a view showing an outline of a blow forming step performed by the forming device and a flow after the blow forming step.

FIG. 5 is a view showing an outline of a blow forming step performed by the forming device and a flow after the blow forming step. As shown in FIG. 5, the blow forming die 13 is closed with respect to the heated metal pipe material 14, and the metal pipe material 14 is disposed in the cavity of the blow forming die 13 and is sealed. Thereafter, the cylinder unit 42 of the gas supply mechanism 40 is operated, and thus, both ends of the metal pipe material 14 are sealed by the seal members 44 (also refer to FIGS. 3A to 3C). After the sealing is completed, the blow forming die 13 is closed, the gas is sucked into the metal pipe material 14, and the heated and softened metal pipe material 14 is formed according to a shape of the cavity (a specific forming method of the metal pipe material 14 will be described later).

The metal pipe material 14 is heated to a high temperature (approximately 950□c) and softened, and thus, the gas supplied into the metal pipe material 14 thermally expands. Accordingly, for example, the supplied gas serves as compressed air or compressed nitrogen gas, the metal pipe material 14 having a temperature of 950□C is easily expanded by the compressed air which is thermally expanded, and the metal pipe 100 can be obtained.

Specifically, an outer peripheral surface of the blow-formed and expanded metal pipe material 14 comes into contact with the cavity surface 16 of the lower die 11 so as to be rapidly cooled and comes into contact with the cavity surface 24 of the upper die 12 so as to be rapidly cooled (the upper die 12 and the lower die 11 have a large heat capacity and are controlled to a low temperature, and thus, if the metal pipe material 14 comes into contact with the upper die 12 and the lower die 11, a heat of a pipe surface is taken to the die side at once), and thus, hardening is performed on the metal pipe material 14. The above-described cooling method is referred to as die contact cooling or die cooling. Immediately after being rapidly cooled, austenite transforms into martensite (hereinafter, transformation from austenite to martensite is referred to as martensitic transformation). The cooling rate decreased in a second half of the cooling, and thus, martensite transforms into another structure (such as troostite, sorbite, or the like) due to recuperation. Therefore, it is not necessary to separately perform tempering treatment. In addition, in the present embodiment, the cooling may be performed by supplying a cooling medium to the metal pipe 100, instead of or in addition to the cooling of the die. For example, in order to perform the cooling, the metal pipe material 14 comes into contact with the die (upper die 12 and lower die 11) until a temperature at which the martensitic transformation starts, and thereafter, the die is opened and a cooling medium (cooling gas) is blown onto the metal pipe material 14, and thus, the martensitic transformation is generated.

Next, a configuration for forming the flange portions will be described in detail with reference to FIGS. 2A and 2B and FIGS. 7A to 7C. Moreover, in FIG. 2A, the upper die 12 and the lower die 11 are open. Accordingly, strictly, the main cavity portion MC and the sub cavity portions SC1 and SC2 are not formed. However, for the sake of explanation, the portions corresponding to a die shape for forming the cavity portions are attached by "MC", "SC1", and "SC2". In addition, in descriptions later, flange forming surfaces F1 and F3 are face each other and are surfaces which constitute the sub cavity portion SC1. Flange forming surfaces F2 and F4 face each other and are surfaces which constitute the sub cavity portion SC2.

As shown in FIG. 2A, the protrusion portions 111A and 111B are formed on the flange forming surfaces F1 and F2 of the sub cavity portions SC1 and SC2 of lower die 11, respectively. The protrusion portions 111A and 111B are portions which protrude toward sides of the flange forming surfaces F3 and F4 from the flange forming surfaces F1 and F2. Here, the flange forming surface F1 of the sub cavity portion SC1 of the lower die 11 corresponds to an upper surface of the second protrusion 11*c*. The flange forming surface F2 of the sub cavity portion SC2 of the lower die 11 corresponds to an upper surface of the third protrusion 11*d*. In addition, the protrusion portions 110A and 110B are formed on the flange forming surfaces F3 and F4 of the sub cavity portions SC1 and SC2 of upper die 12, respectively. The protrusion portions 110A and 110B are portions which protrude toward sides of the flange forming surfaces F1 and F2 from the flange forming surfaces F3 and F4. Here, the flange forming surface F3 of the sub cavity portion SC1 of the upper die 12 corresponds to a lower surface of the second protrusion 12*c*. The flange forming surface F4 of the sub cavity portion SC2 of the upper die 12 corresponds to an upper surface of the fourth protrusion 12*e*.

Each of the upper surfaces of the protrusion portions 111A and 111B is constituted by a flat surface which is disposed at a position higher than those of the flange forming surfaces F1 and F2. However, a shape of each of the upper surfaces of the protrusion portions 111A and 111B is not particularly limited and may be a curved surface or the like. Each of the lower surfaces of the protrusion portions 110A and 110B is constituted by a flat surface which is disposed at a position lower than those of the flange forming surfaces F3 and F4. However, a shape of each of the lower surfaces of the protrusion portions 110A and 110B is not particularly limited and may be a curved surface or the like. In addition, a protrusion amount of each of the protrusion portions 110A, 110B, 111A, and 111B is not particularly limited. However, it is preferable that the protrusion amount is approximately 1 to 2 mm. In addition, the protrusion portions 110A and 110B are integrally formed with the upper die 12, and the protrusion portions 111A and 111B are integrally formed with the lower die 11. However, only the protrusion portions 110A, 110B, 111A, and 111B may be formed separately from the die. In addition, only at least one of the protrusion portions 111A and 111B may be formed. Only at least one of the protrusion portions 110A and 110B may be formed.

Next, a state when the protrusion portion 111A is viewed from above will be described with reference to FIG. 2B. Moreover, the other protrusion portions 111B, 110A and 110B also have the same structure. As shown in FIG. 2B, the protrusion portion 111A is formed inside an outer end portion E1 of the flange forming surface F1. In addition, the protrusion portion 111A is formed inside an inner end portion E2 of the flange forming surface F1. Moreover, a width of the protrusion portion 111A is not particularly limited. However, it is preferable that the width is approximately 80% of the flange forming surface such that the flange portion can be pressed locally. In addition, a position of the protrusion portion 111A in a width direction of the flange forming surface F1 is not particularly limited.

The protrusion portions 111A are intermittently formed on the flange forming surface F1 along an extension direction (that is, a direction in which the metal pipe extends) of the main cavity portion MC. Therefore, a gap GP is formed between one protrusion portion 111A and another protrusion portion 111A in the extension direction. There is no particular limitation on how much a size of gap GP is secured. In addition, the protrusion portion 111A may be continuously formed along the extension direction of the main cavity portion MC such that the gap GP is not formed. In the aspect shown in FIG. 2B, the protrusion portion 111A has an oval shape, but a shape of the protrusion portion 111A is not particularly limited.

Figure 7A:
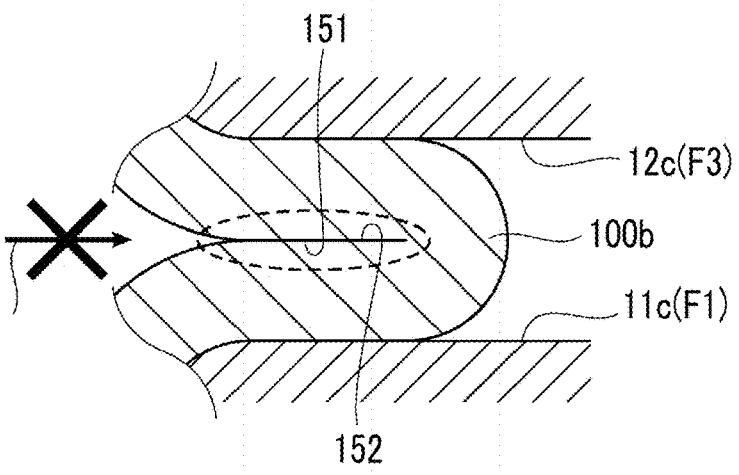
FIGS. 7A to 7C are enlarged views of flange portions according to an example and comparative example.
Figure 7B:
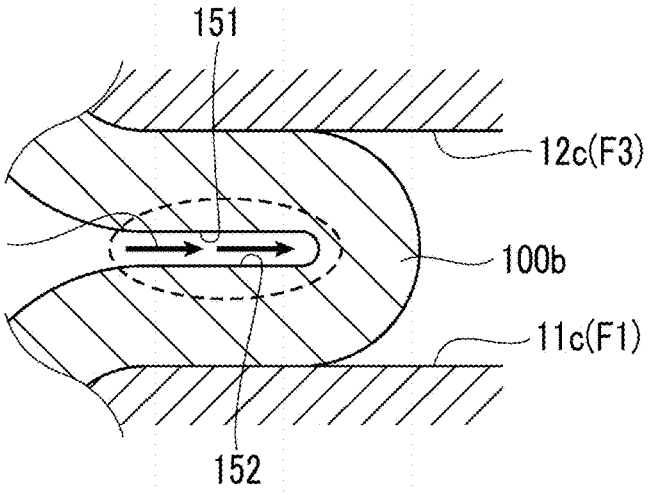
Figure 7C:
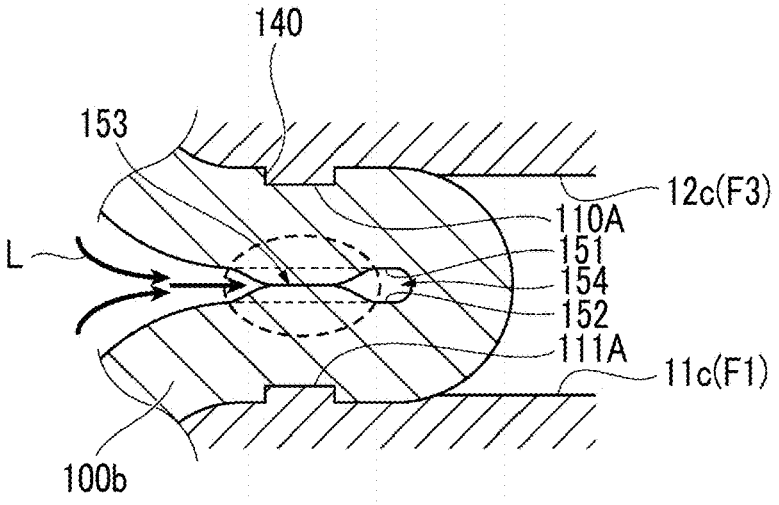
Figure 9A:
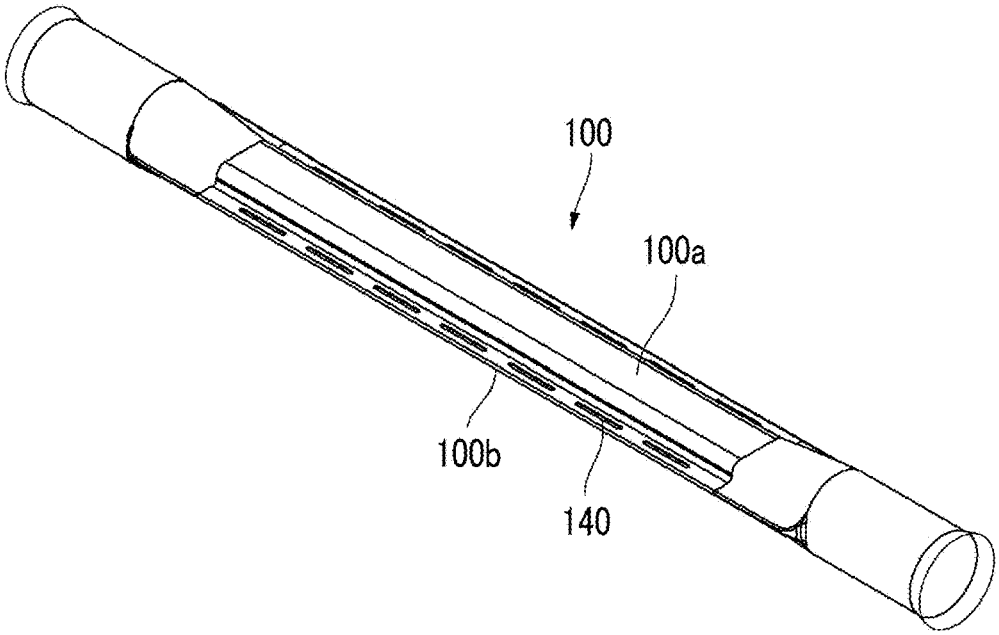
FIGS. 9A and 9B are views showing an example of a metal pipe formed by the forming device according to the present embodiment.
Figure 9B:
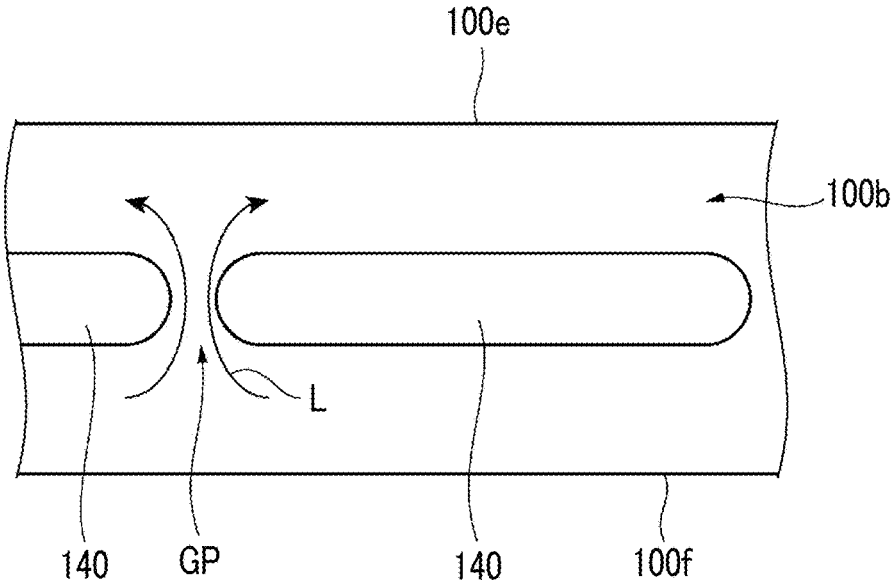

According to the above-described configuration, the flange portion 100*b* is partially pressed by the protrusion portions 111A, 111B, 110A, and 110B, and thus, as shown in FIG. 7C and FIGS. 9A and 9B, a concave portion 140 partially recessed is formed in the flange portion 100*b* of the metal pipe 100. More specifically, as shown in FIG. 9B, in the flange portion 100*b*, the concave portions 140 are formed in shapes (here, oval shapes) and at positions corresponding to the protrusion portions 111A, 111B, 110A, and 110B. Here, the concave portion 140 is separated inward from an outer end portion 100*e* of the flange portion 100*b* and is located outside the inner end portion 100*f*. In addition, the concave portions 140 intermittently formed in the extension direction of the flange portion 100*b*. The gap GP is formed between a concave portion 140 and another concave portion 140 at a position in the extension direction.

Next, operations and effects of the forming device 10 according to the present embodiment and the forming method using the forming device 10 will be described.

According to the forming device 10 of the present embodiment, the upper die 12 and the lower die 11 constitute sub cavity portions SC1 and SC2 communicating with the main cavity portion MC, and thus, the flange portion 100*b* of the metal pipe 100 can be formed by crushing a portion of the pipe portion 100*a* with the sub cavity portions SC1 and SC2.

Here, as shown in FIG. 7A, in a case where the entire flange portion 100*b* is crushed firmly, an inner surface 151 and 152 facing each other inside the flange portion 100*b* are close to each other or come into contact with each other, and thus, a space inside the flange portion 100*b* is narrowed or crushed. Accordingly, a coating liquid L does not enter the inside of the flange portion 100*b*. Meanwhile, as shown in FIG. 7B, in a case where the inner surface 151 and the inner surface 152 are separated from each other inside the flange portion 100*b* and an internal space of the flange portion 100*b* is large, the coating liquid L easily enters. However, the space of the flange portion 100*b* is too large, and thus, weldability decreases.

Meanwhile, in the forming device 10 of the present embodiment, the protrusion portions 110A, 110B, 111A, and 111B are formed on the flange forming surfaces F1, F2, F3, and F4 of the sub cavity portions SC1 and SC2 of the upper die 12 and the lower die 11. Accordingly, as shown in FIG. 7C, the inner surfaces 151 and 152 facing each other are separated from each other inside the flange portion 100*b*, and thus, a gap portion 154 in which a gap is formed and a proximity portion 153 in which the inner surfaces 151 and 152 are close to each other compared to the gap portion 154 are formed. In the flange portion 100*b*, the concave portions 140 corresponding to the protrusion portions 110A, 110B, 111A, and 111B can be crushed more firmly than the other portions. Accordingly, the proximity portion 153 is formed. Therefore, the weldability of the flange portion 100*b* can be secured by performing welding at the concave portions 140 which are portions corresponding to the protrusion portions 110A, 110B, 111A, and 111B in the flange portion 100*b*. Meanwhile, in the flange portion 100*b*, the gap portions 154 are formed in portions other than the protrusion portions 110A, 110B, 111A, and 111B, and thus, it is possible to secure a gap in which the coating liquid L can enter. As described above, the coating liquid can easily enter the inside of the flange portion 100*b* while the weldability of the flange portion 100*b* of the metal pipe 100 is secured.

In addition, the protrusion portions 110A, 110B, 111A, and 111B are intermittently formed along the extension direction of the main cavity portion MC in the flange forming surfaces F1, F2, F3, and F4. In this case, the gaps GP are formed in the extension direction of the sub cavity portions SC1 and SC2 at the locations pressed by the protrusion portions 110A, 110B, 111A, and 111B. For example, as shown in FIG. 9B, the coating liquid L enters the gap GP, and thus, coating liquid L can easily enter throughout the entire flange portion 100*b*.

In addition, the protrusion portions 110A, 110B, 111A, and 111B are formed inside the outer end portions E1 of the flange forming surfaces F1, F2, F3, and F4. In this case, the concave portion 140 which is the welding location can also be set inside the outer end portion E1 in the flange portion 100*b*. Accordingly, it is possible to easily perform a welding operation.

The forming method according to the present embodiment is a method of forming the metal pipe 100 having the pipe portion 100*a*, and the heated metal pipe material 14 is prepared between the upper die 12 and the lower die 11. By moving at least one of the upper die 12 and the lower die 11 in a direction in which the dies are joined to each other, the main cavity portion MC for forming the pipe portion 100*a* and sub cavity portions SC1 and SC2 which communicate with the main cavity portion MC and form the flange portion

100*b* of the metal pipe 100 are formed between the upper die 12 and the lower die 11, the pipe portion 100*a* and the flange portion 100*b* extending from the pipe portion are formed by supplying a gas into the metal pipe material 14, and the gap portion 154 in which the inner surfaces 151 and 152 facing each other are separated from each other to form the gap and the proximity portion 153 in which the inner surfaces 151 and 152 are close to each other compared to the gap portion 154 are formed inside the flange portion 100*b*.

According to this forming method, it is possible to obtain operations and effects similar to those of the above-described forming device 10.

The present invention is not limited to the above-described embodiment.

Figure 8:
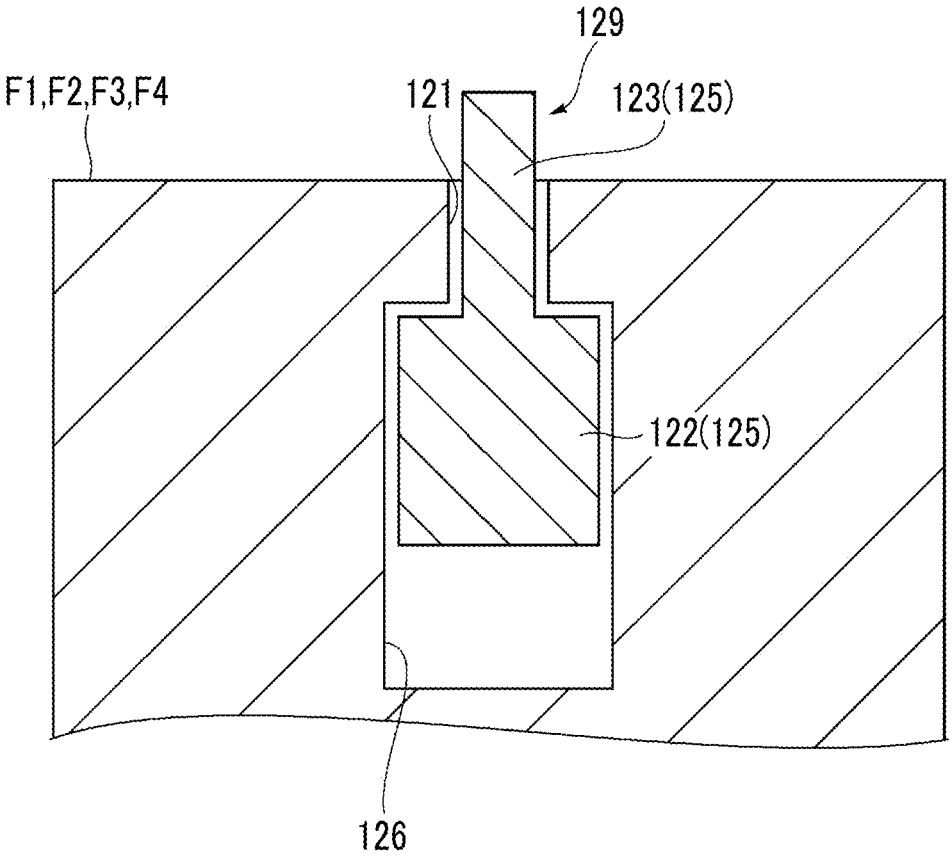
FIG. 8 is a schematic sectional view showing a protrusion mechanism of a forming device according to a modification example.

For example, in the above-described embodiment, the protrusion is fixed to the upper die and the lower die. However, a protrusion mechanism which moves with respect to the upper die and the lower die may be adopted. As shown in FIG. 8, a protrusion mechanism 129 is formed in a portion of each of the flange forming surfaces F1, F2, F3, and F4 of the sub cavity portions SC1 and SC2 of the upper die 12 and the lower die 11. The protrusion mechanism 129 is a mechanism which is switchable between a protrusion and a non-protrusion from the flange forming surfaces F1, F2, F3, and F4. The protrusion mechanism 129 includes a pressing member 125 in an accommodation portion 126 provided in the die. The pressing member 125 includes a large diameter portion 122 having a large diameter on a lower end side of the pressing member 125 and a small diameter portion 123 having a small diameter on an upper end (tip) side of the pressing member 125. Moreover, the first accommodation portion 126 for accommodating the large diameter portion 122 and a second accommodation portion 121 for accommodating the small diameter portion 123 are formed in the die. Accordingly, the protrusion mechanism 129 is moved at a necessary timing, and the small diameter portion 123 protrudes from the flange forming surfaces F1, F2, F3, and F4. Accordingly, at the time of the protrusion, the protrusion mechanism 129 protrudes to the sides of the flange forming surfaces F3 and F4 from the flange forming surface F1 and F2. In addition, at the time of the protrusion, the protrusion mechanism 129 protrudes to the sides of the flange forming surfaces F1 and F2 from the flange forming surface F3 and F4. Specifically, after the flange portion 100*b* is formed, the protrusion mechanism 129 operates the pressing member 125, and thus, the flange portion 100*b* can be partially pressed. In addition, a positional relationship in the flange forming surfaces F1, F2, F3, and F4 is the same as the protrusion portion 111A shown in FIG. 2B. Moreover, the protrusion mechanism may be driven by an electric mechanism such as a ball screw, a hydraulic mechanism such as a hydraulic pump, or the like.

According to the forming device 10, in forming device 10, the protrusion mechanism 129 is formed on the flange forming surfaces F1, F2, F3, and F4 of the sub cavity portions SC1 and SC2 of the upper die 12 and the lower die 11. Therefore, as shown in FIG. 7C, in the flange portion 100*b*, the concave portion 140, which is a portion corresponding to the projection mechanism 129, can be crushed more firmly than the other portions. Therefore, the weldability of the flange portion 100*b* can be secured by performing the welding at the concave portion 140 which is the portion corresponding to the protrusion mechanism 129 in the flange portion 100*b*. Meanwhile, in the flange portion 100*b*, portions other than the protrusion mechanism 129 can secure the gap which can allow the entering of the coating liquid L. As described above, the coating liquid can easily enter the inside of the flange portion 100*b* while the weldability of the flange portion 100*b* of the metal pipe 100 is secured.

In addition, the protrusion portion 129 is intermittently formed along the extension direction of the main cavity portion MC in the flange forming surfaces F1, F2, F3, and F4. In this case, the gap GP is formed in the extension direction of the sub cavity portions SC1 and SC2 at the location pressed by the protrusion mechanism 129. For example, as shown in FIG. 9B, the coating liquid L enters the gap GP, and thus, coating liquid L can easily enter throughout the entire flange portion 100*b*.

In addition, the protrusion mechanism 129 is formed inside the outer end portions E1 of the flange forming surfaces F1, F2, F3, and F4. In this case, the concave portion 140 which is the welding location can also be set inside the outer end portion E1 in the flange portion 100*b*. Accordingly, it is possible to easily perform a welding operation.

Figure 10A:
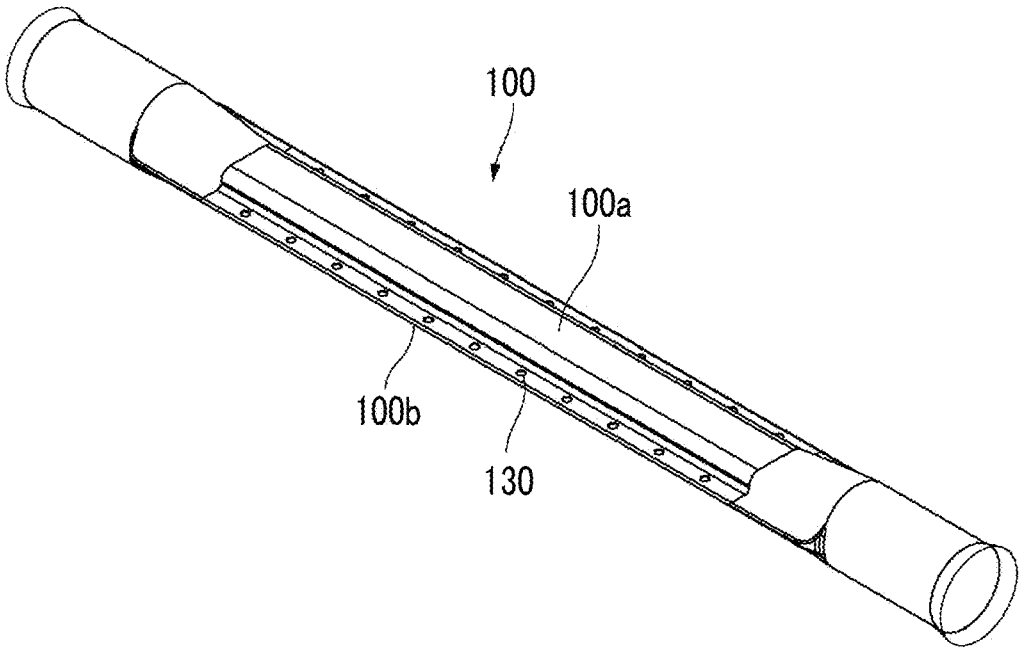
FIGS. 10A and 10B are views showing an example of a metal pipe formed by the forming device according to the present embodiment.
Figure 10B:
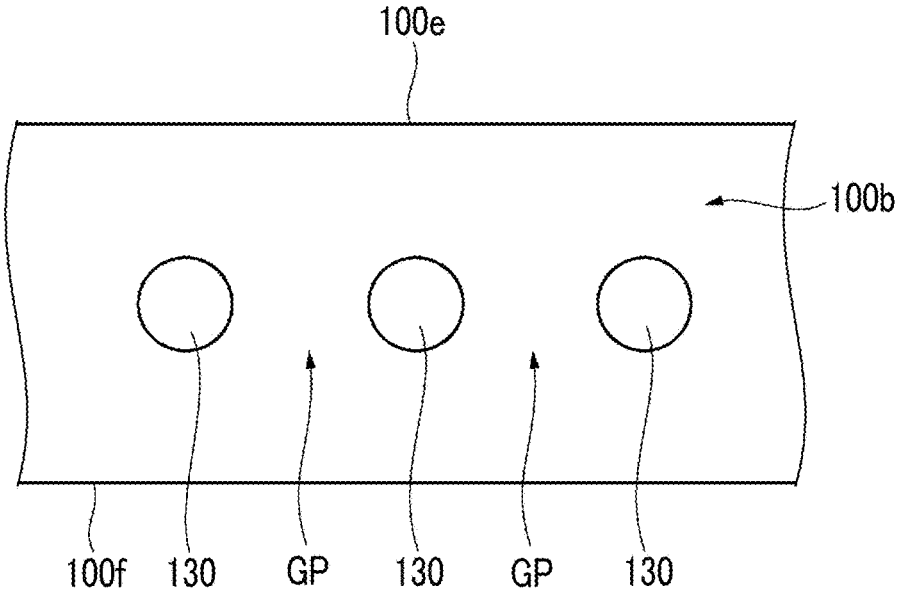
Figure 11A:
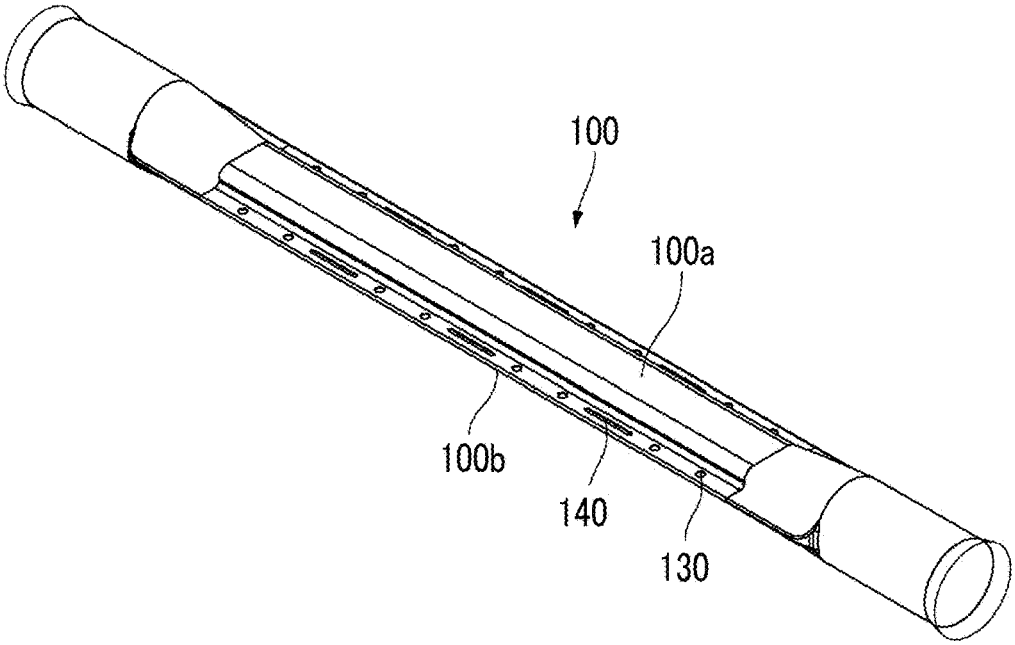
FIGS. 11A and 11B are views showing an example of a metal pipe formed by the forming device according to the present embodiment.
Figure 11B:
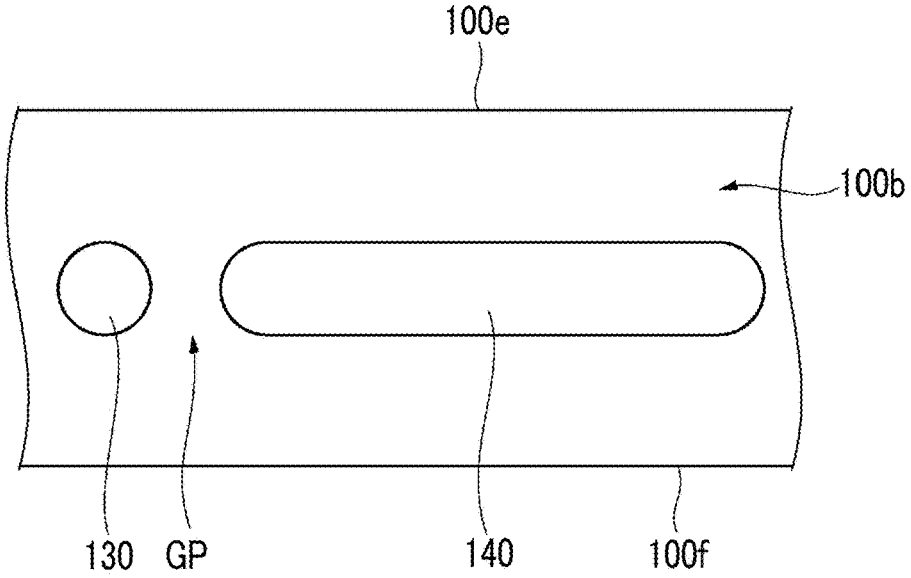

Shapes of the protrusion portion and the protrusion mechanism, and a shape of the concave portion of the flange portion 100*b* formed thereby are not particularly limited. For example, a metal pipe 100 may be formed as shown in FIG. 10A. As shown in FIG. 10B, circular concave portions 130 may be spaced apart from each other in an extension direction. In addition, for example, a metal pipe 100 may be formed as shown in FIG. 11A. As shown in FIG. 11B, circular concave portions 130 and oval concave portions 140 may be disposed so as to be separated from each other in an extension direction in a state where the circular concave portions 130 and the oval concave portions are mixed with each other.

Figure 12A:
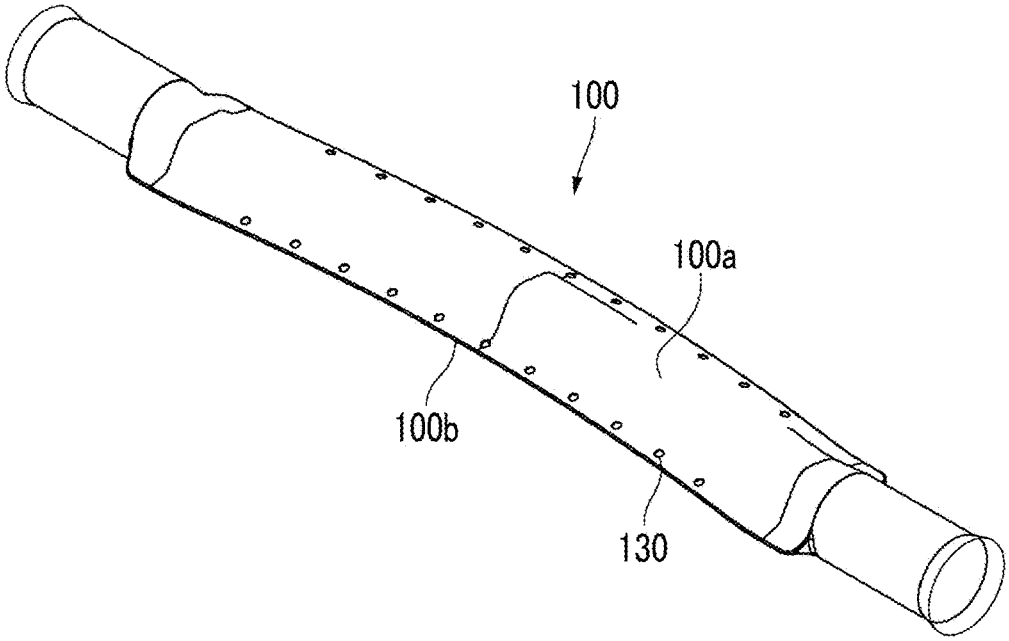
FIGS. 12A and 12B are views showing an example of a metal pipe formed by the forming device according to the present embodiment.
Figure 12B:
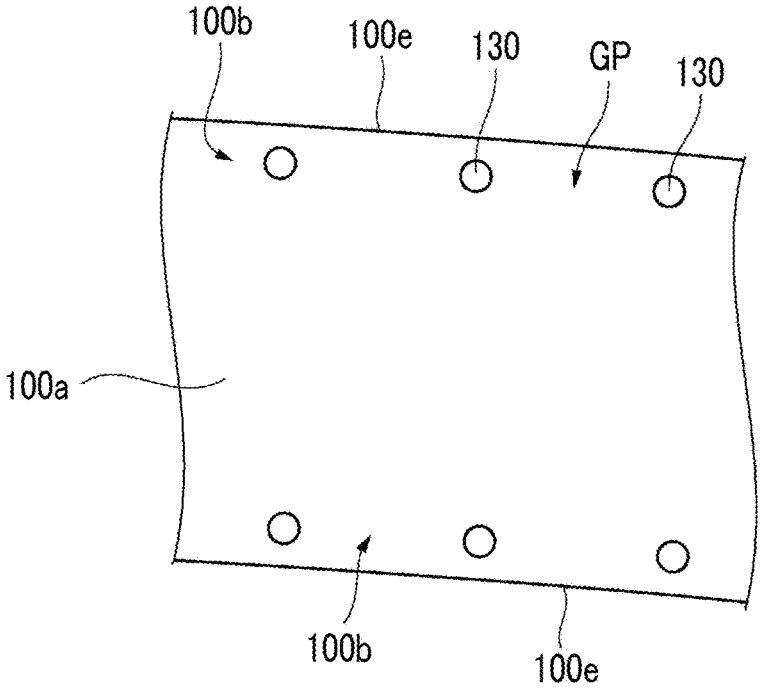
Figure 13A:
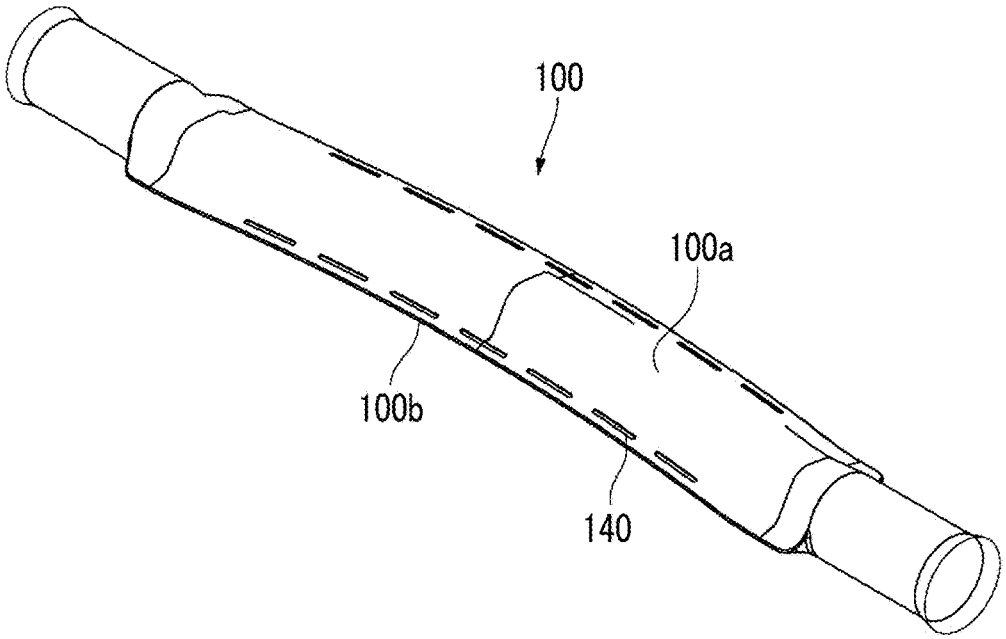
FIGS. 13A and 13B are views showing an example of a metal pipe formed by the forming device according to the present embodiment.
Figure 13B:
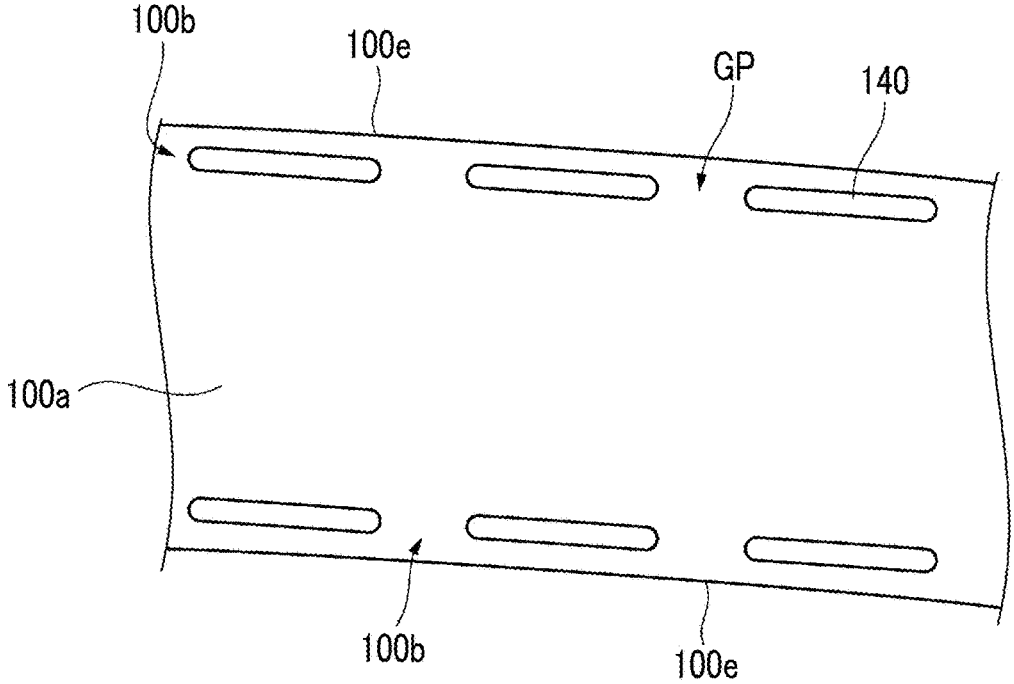

Moreover, a shape of the metal pipe 100 is not particularly limited, and as shown in FIG. 12A and FIG. 13A, the pipe portion 100*a* may be bent as a whole. In addition, as shown in FIG. 12B, circular concave portions 130 may be adopted, and as shown in FIG. 13B, oval concave portions 140 may be adopted.

Moreover, in the drive mechanism 80 according to the above-described embodiment, only the upper die 12 is moved. However, the lower die 11 may be moved in addition to upper die 12 or instead of the upper die 12. In a case where the lower die 11 moves, the lower die 11 is not fixed to the base 15 but attached to the slide of the drive mechanism 80.

In addition, the metal pipe 100 according to the above-described embodiment may have the flange portion on one side of the metal pipe 100. In this case, one sub cavity portion is formed by the upper die 12 and the lower die 11.

It should be understood that the invention is not limited to the above-described embodiment, but may be modified into various forms on the basis of the spirit of the invention. Additionally, the modifications are included in the scope of the invention.

What is claimed is:

1. A forming device for forming a metal pipe having a pipe portion, the forming device comprising:

a pair of dies comprising:

a first die that comprises a first flange forming surface, a protrusion portion inside an outer end portion of the first flange forming surface, and a second die that comprises a second flange forming surface;

a driver configured to:

move, so that the first die and the second die constitute a first cavity portion which forms the pipe portion and a second cavity portion which communicates with the first cavity portion, the first die or the second die in a direction in which the dies are joined to each other; and a gas supplier configured to:

supply, so as to form a flange portion of the metal pipe, a gas into a heated metal pipe material while the heated metal pipe material is held between the first die and the second die, wherein, when the driver joins the first die and the second die to each other:

the protrusion portion protrudes from the first flange forming surface toward the second flange forming surface, the first flange forming surface faces the second flange forming surface to constitute the second cavity portion, and inner surfaces of the flange portion face each other, wherein, when the gas supplier supplies the gas into the heated metal pipe material:

the protrusion portion forms, inside the flange portion, a gap portion where the inner surfaces are separated from each other and a proximity portion where the inner surfaces of the flange portion are close to each other compared to the gap portion.

2. The forming device according to claim 1, wherein the protrusion portion forms the gap portion inside an outer end portion of the flange portion, and the protrusion portion forms the proximity portion inside the outer end portion of the flange portion.

3. The forming device according to claim 2, wherein the protrusion portion forms the proximity portions intermittently along an extension direction of the flange portion, and the protrusion portion forms the gap portion between the proximity portions adjacent to each other.

4. A forming method of forming a metal pipe having a pipe portion and a flange portion, the method comprising:

preparing a heated metal pipe material between a first die and a second die;

moving, by a driver, the first die or the second die in a direction in which the first die and the second die are joined to each other; and supplying, into the heated metal pipe material from a gas supplier, a gas that forms the pipe portion and the flange portion extending from the pipe portion, wherein when the first and second dies are closed, the first die and the second die constitute:

a first cavity portion which forms the pipe portion, and a second cavity portion which communicates with the first cavity portion and forms the flange portion, wherein a gap portion and a proximity portion are formed inside the flange portion when the flange portion is formed by supplying the gas into the heated metal pipe material, wherein inner surfaces of the flange portion face each other, wherein the gap portion is where the inner surfaces are separated from each other, and wherein the proximity portion is where the inner surfaces are close to each other compared to the gap portion.

* * * * *